US006155575A

United States Patent [19]

Hawkins et al.

[11] Patent Number: 6,155,575

[45] Date of Patent: Dec. 5, 2000

[54] FLUID PASSAGE PLUGGING ARRANGEMENT FOR A CRANKSHAFT

[75] Inventors: Colin A. Hawkins; David R. Mc Parland, both of Lafayette, Ind.

[73] Assignee: Caterpillar Inc., Peoria, Ill.

[21] Appl. No.: 09/039,071

[22] Filed: Mar. 13, 1998

[51] Int. Cl.[7] ..... F02F 11/10; F16J 15/02; F01M 9/10; F15D 1/02

[52] U.S. Cl. ..... 277/591; 277/598; 277/630; 123/196 R; 123/90.37; 138/89

[58] Field of Search ..... 277/591, 598, 277/603, 630, 637, 910; 123/196 R, 196 CP, 90.37; 184/6.5; 138/89

[56] References Cited

U.S. PATENT DOCUMENTS

| | | | |
|---|---|---|---|
| 3,785,142 | 1/1974 | Soguel | 277/910 X |
| 4,600,036 | 7/1986 | Noe | 138/89 |
| 5,174,250 | 12/1992 | Lane | 277/361 X |
| 5,237,976 | 8/1993 | Lawrence et al. | 123/508 |
| 5,291,842 | 3/1994 | Sallstrom et al. | 277/910 X |
| 5,439,031 | 8/1995 | Steele et al. | 138/89 |
| 5,509,476 | 4/1996 | Vick, Jr. | 138/89 X |
| 5,667,305 | 9/1997 | Walker | 374/148 |
| 5,694,978 | 12/1997 | Heilmann et al. | 138/89 |

*Primary Examiner*—Anthony Knight
*Assistant Examiner*—Robert L. Pilaud
*Attorney, Agent, or Firm*—Alan J. Hickman

[57] ABSTRACT

A first fluid passage for a crankshaft is plugged at an end portion to prevent fluid leakage from the passage. A plug having first and second cylindrical end portions of different diameters is slidably disposed in first and second cylindrical bore portions, respectively, of the first fluid passing passage and retained in the bore portions by a stop ring. A resilient member disposed in the second cylindrical bore portion engages a shoulder on the plug and a transition step surface in the second cylindrical bore portion and forcibly urges the plug against the stop ring.

12 Claims, 2 Drawing Sheets

FLUID PASSAGE PLUGGING ARRANGEMENT FOR A CRANKSHAFT

TECHNICAL FIELD

This invention relates to a plugging arrangement for a fluid passage and more particularly to a plug slidably movably disposed in a bore of a fluid passing passage of a crankshaft and maintained from inadvertent movement in the bore by the force of a resilient member.

BACKGROUND ART

Plugs used to seal an end portion of a fluid passing passage in a crankshaft have been used for decades. The end portion is plugged to force lubricating fluid, such as lubricating oil, to flow through other intersecting fluid passing passages for the purpose of delivering pressurized lubricating fluid to engine bearings, such as, main and rod journal bearings.

It has been found that in the fluid passing passage, a dead space normally exists between the plug and an intersecting juncture of a connecting passage. This dead space tends to collect operating residue of the type normally associated with engine operation and wear. This ultimately results in a buildup of this residue between the plug and the intersecting juncture. Should this build up become excessive, the intersecting passage may become blocked. This restricts the flow of lubricating fluid to at least the engine bearings and premature wear of the bearings and associated components.

In the past, it has been a common practice in some engines to be able to remove the plug and clean the passage when appropriate. This requires that the engine is substantially disassembled in order to gain full access the crankshaft. This results in engine down time and in a loss of engine productivity. Such maintenance is also very expensive.

Sealing plugs are normally disposed in the bore and held in place by pressing, screw threads, or other well known mechanical maintaining arrangements. Plugs held in by pressing are difficult and often impossible to remove. It is often necessary to remove the crankshaft from the engine in order to remove the pressed in plug. In some cases the crankshaft requires machining or replacement because of damage caused by plug removal.

Plugs connected by screw threads are not acceptable in some engines as they tend to become unscrewed during engine operation. This is particularly true in engines with an unbalanced firing order, for example, an engine with a nine throw crank. In engines such as this, a large internal bending order causes vibration. This causes a working out of the plug during operation.

Plugs that are held in place by snap rings and the like tend to rattle around in the bore in which they are disposed. This causes wear of the crankshaft within the bore and results in a leakage path for the lubricating fluid.

It is desirable to eliminate the dead space, to provide a plug that is rattle free and one that is easily removable from the crankshaft without requiring excessive engine disassembly.

The present invention is directed to overcoming one or more of the problems as set forth above.

DISCLOSURE OF THE INVENTION

A fluid passage plugging arrangement for sealing a fluid passing passage disposed in a crank shaft is provided. The fluid passage plugging arrangement includes a plug having a longitudinal axis, first and second cylindrical end portions of different diameters substantially concentrically disposed about said longitudinal axis and first and second opposed ends. A shoulder is located at a juncture of connection between the first and second end portions of the plug. A first annular groove is disposed in and circumferentially about the first cylindrical end portion of the plug. A bore having first and second cylindrical bore portions are disposed in the crankshaft. The second cylindrical bore portion axially opens into the first cylindrical bore portion. The first and second cylindrical bore portions are substantially concentric and define at least a portion of the fluid passing passage. A transition step surface is located axially within the first cylindrical bore portion at a juncture of axial opening of the second cylindrical bore portion into the first cylindrical bore portion. A second annular groove is disposed in the second cylindrical bore portion at a predetermined axial distance spaced from the transition step surface. The plug is disposed in the bore. A non-metallic seal is disposed in the first annular groove and sealingly engaged with the first cylindrical bore. A stop ring is disposed in the second annular groove. A resilient member is disposed in the second bore and engaged with the shoulder and the transition step surface. The resilient member urges the second end of the plug into engagement with the stop ring and maintains the plug from inadvertent movement within the bore.

BEST MODE FOR CARRYING OUT THE INVENTION

Figure 1:
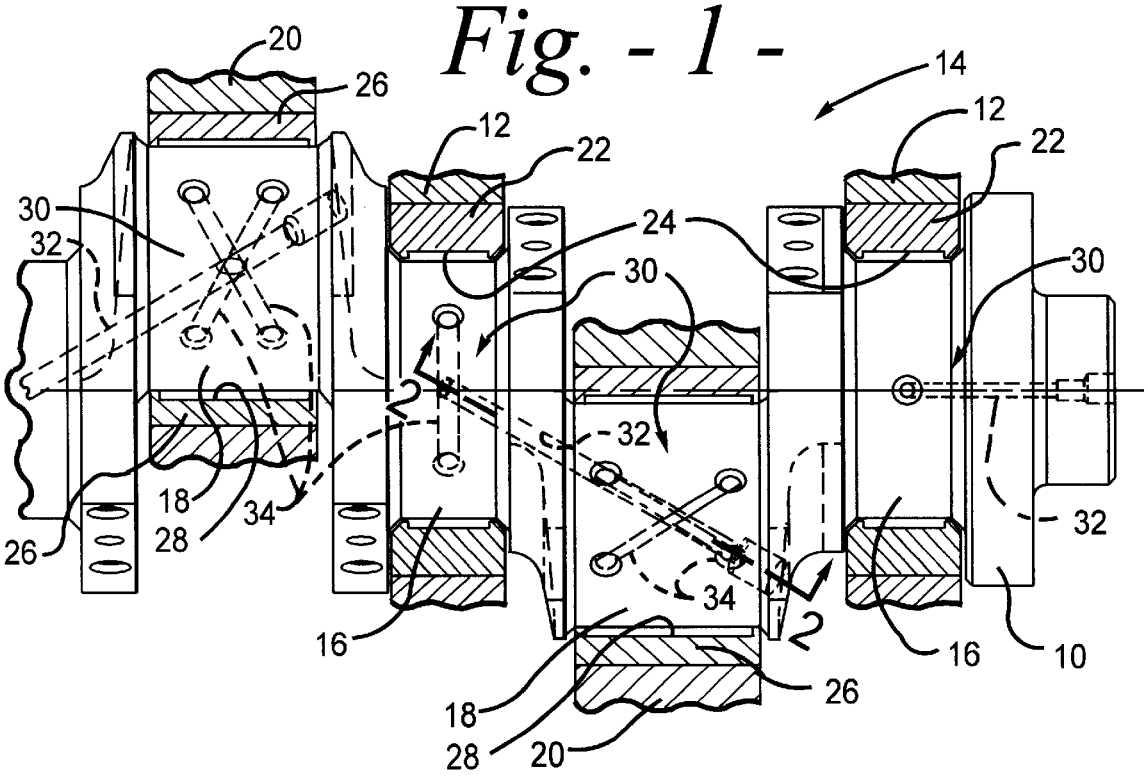
FIG. 1 is a partial diagrammatic view of a of an embodiment of the present invention showing a crankshaft with the fluid passage plugging arrangement.

With reference to FIG. 1, a portion of a crankshaft 10 of the type used in an engine block 12 of internal combustion engine 14, for example, a diesel engine, is shown. The crankshaft 10 has a plurality of longitudinally spaced apart cylindrical journals 16 used to rotatively support the crank shaft 10 in the engine block 12 in a conventional manner. The crankshaft 10 also has a plurality of spaced apart cylindrical rod journals 18 provided to connect a respective plurality of connecting rods 20 to the crank shaft 10 in a conventional manner. The rod journals 18 are radially offset from main journals 16 and substantially axially parallel to each other and to the main journals 16. This construction is typical of conventional crankshafts and of the type well known in the art.

A plurality of main journal bearings 22 are disposed about the main journals 16 and located between the engine block 12 and the respective main journals 16. The main journal bearings 22 are preferably sleeve bearings, but not limited thereto, manufactured from any suitable conventional metallic material or combination of materials capable of withstanding the operating forces typically associated therewith. The main bearings 22 each have an annular groove 24 for passing lubricating fluid flow to aid in the distribution of lubricating fluid to lubricate the main bearings 22 and the main journals 16 in a conventional manner.

A plurality of rod bearings 26 are disposed about the rod journals 18 between the connecting rod 20 and the respective rod journals 18. The rod bearings 26 are preferably sleeve bearings, but not limited thereto, manufactured from any suitable conventional metallic material or combination of materials capable of withstanding the forces of operation typically associated therewith. The rod bearings 26 each have an annular groove 28 for passing lubricating fluid flow to lubricate the rod bearings 26 and the rod journals 18.

A plurality of fluid passing passages 30 are disposed in the crank shaft 10. The passages 30 are provided to pass lubricating fluid flow between a source of pressurized lubricating fluid flow (not shown) and the bearings 22,26. The passages 30 include at least a first fluid passing passage 32 and one or more second fluid passing passages 34. The second fluid passing passage 34 intersects the first fluid passing passage 32 at a predetermined location along the length thereof and relative to an adjacent one of the plurality of journals 16,18. The first and second fluid passing passages 32,34 are typically drilled and substantially straight.

Figure 2:
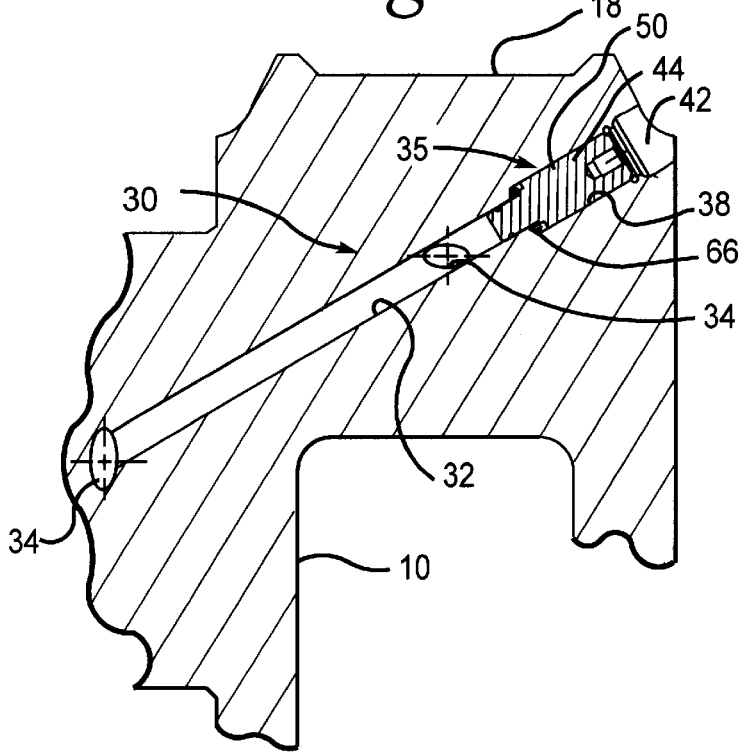
FIG. 2 is a diagrammatic cross-sectional view taken axially along lines 2—2 of FIG. 1 showing a fluid passing passage, an intersecting fluid passing passage and a plugging arrangement for the fluid passing passage of the crankshaft.
Figure 3:
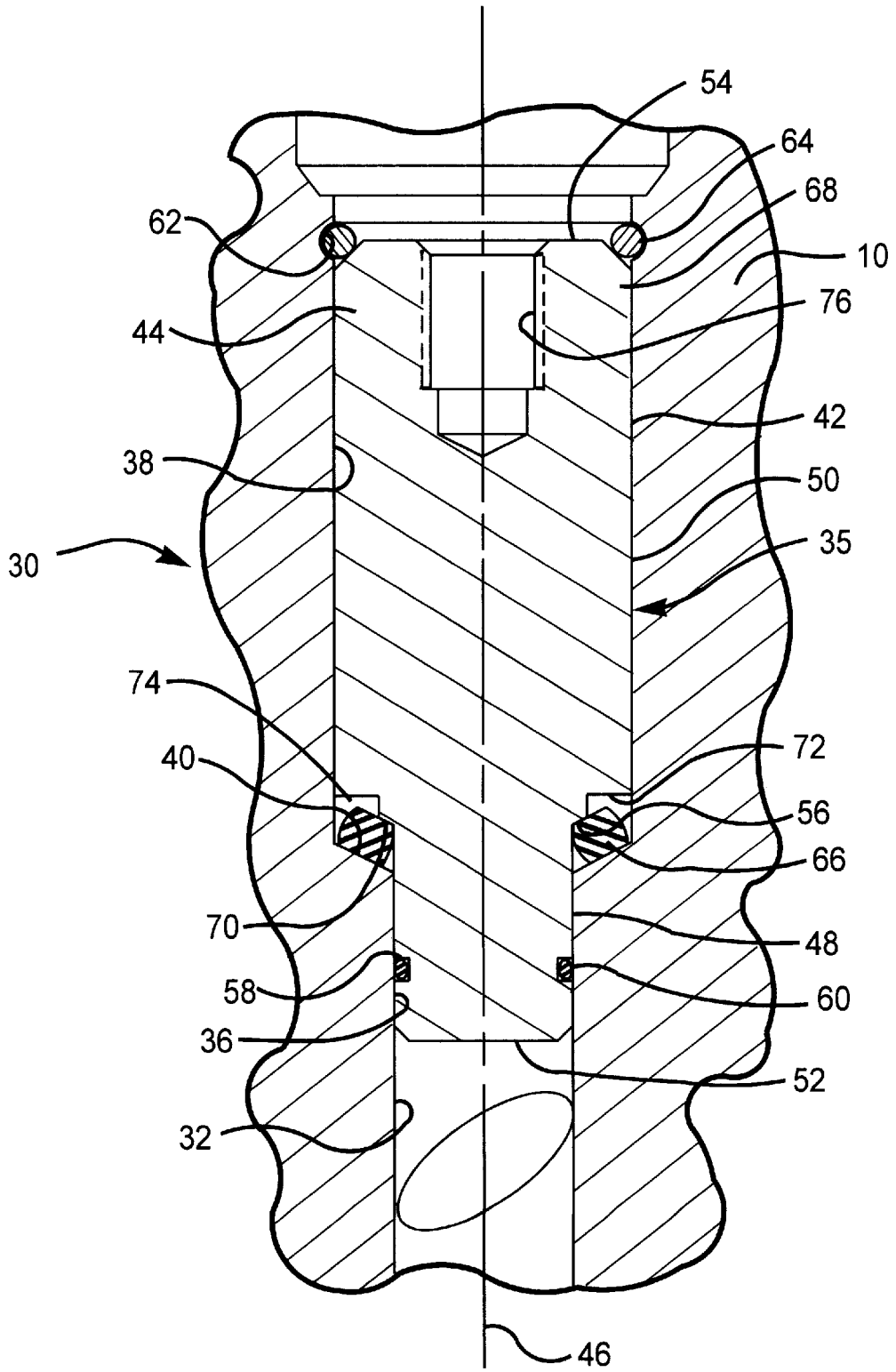
FIG. 3 is an enlarged diagrammatic cross-sectional view of a the fluid passage plugging arrangement of FIG. 2.

As best seen in FIGS. 2 and 3, a bore 35 having first and second concentric cylindrical bore portions 36,38 of different diameters is disposed in the crankshaft 10. The first and second cylindrical bore portions 36,38 define at least an end portion 42 of the first fluid passing passage 32. The first cylindrical bore portion 36 axially opens into the second cylindrical bore portion 38. A transition step surface 40 within the second cylindrical bore portion 38 is located axially within the first passage 32 at a juncture of axial opening of the first cylindrical bore portion 36 into the second cylindrical bore portion 38. The transition step surface 40 is at a predetermined acute angle relative to a plane normal to a longitudinal axis of the first and second bore portions 36,38. The second cylindrical bore portion 38 is open from the crankshaft 10 and requires plugging to prevent the flowing of lubricating fluid therefrom.

A plug 44 for plugging the first passage 32 has a longitudinal axis 46, first and second cylindrical end portions 48,50 of different diameters substantially concentrically disposed about said longitudinal axis 46, and first and second opposed ends 52,54. A shoulder 56, located along the plug 44 at a juncture of connection between the first and second cylindrical end portions 48,50, extends radially therefrom. A first annular groove 58 is disposed in and circumferentially about the first cylindrical end portion 48 of the plug 44. A non-metallic seal 60 is removably disposed in the first annular groove 58. The seal is removable for replacement purposes.

The plug 44 is sealingly disposed in the first passage 10. In particular the first and second cylindrical end portions 48,50 of the plug 44 are disposed in the first and second cylindrical bore portions 36,38, respectively, and slidably axially movable therein. The fit between the first and second bore portions 36,38 and the first and second end portions 48,50 of the plug 44 are respectively loose to permit ease of installation and removal, but of a clearance to provide proper sealing between the non-metallic seal 60 disposed in the first annular groove 58 and the first cylindrical bore portion 36.

A second annular groove 62 is disposed in the second cylindrical bore portion 38 at a predetermined axial distance spaced from the transition step surface 40. A stop ring 64 is disposed in the second annular groove 62 and is engagable with the second cylindrical end portion 50 of the plug 44, particularly the second end 54, in order to maintain the plug 44 in the first fluid passing passage 32.

A resilient member 66 is disposed in the second bore portion 38 and engaged with the shoulder 56 and the transition step surface 40. The resilient member 66 provides a biasing force and urges the second end 54 of the plug 44 into engagement with the stop ring 64 and maintains the plug 44 from inadvertent movement within the bore 35. The resilient member 66 is preferably a flexible annular ring shaped non-metallic member and is disposed circumferentially about the first cylindrical end portion 48 of the plug 44.

The first end 52 of the plug 44 is located in the first bore portion 36 at a preselected location closely adjacent to the predetermined intersecting location of the first and second passages 32,34. This location is significant as it reduces the dead volume in the first passage 32 between the first end 52 of the plug 44 and the intersecting second passage 34. As a result, the potential for particles and the like to collect and dam the lubricating fluid from freely flowing to the bearings 22,26 is reduced.

A chamfer 68 located at the second end 54 of the plug 44 is engaged with the stop ring 64 and forcibly urges the stop ring 64 into seating engagement with the second annular groove 62. The chamfer 68 is at a preselected angle of between 30 and 60 degrees, preferably 45 degrees, and assists in forcing the stop ring 64 into seating engagement with second annular groove 62.

The shoulder 56 has a conical surface portion 70 which is engaged with the resilient member 66. The shoulder 56 also has a step surface 72 axially spaced from the conical surface portion 70 and provides, with the second cylindrical bore portion 38, an area 74 (space) for receiving the resilient member 66 during compressive deformation of the resilient member 66. The conical surface portion 70 is at a predetermined angle sufficient for effectively forcibly urging the resilient member 66 to deform and to cause the resilient member 66 to move into the area 74 during installation of the plug 44 and during placement of the stop ring 64 in the second annular groove 62. After installation of the stop ring 64 in the second annular groove 62 and release of the plug 44, during installation thereof, the resilient member 66 moves somewhat from the area 74. The resilient member 66 continues to provide a predetermined holding force sufficient to maintain the plug 44 from substantial movement in the bore 35 by axially forcibly urging the plug 44 against the stop ring. In this regard, a preselected distance between the second annular groove 62 and the transition surface 40, a preselected distance between the second end 54 of the plug 44 and the shoulder 56, and the dimensions of the resilient member 66 is carefully selected to provide a predetermined biasing force. The nonmetallic material of the resilient member 66 provides sufficient deformation and compression during installation of the plug 44 and stop ring 64 and the predetermined biasing force after assembly of the plug 44 in the bore 35.

The non-metallic seal 60 is closer to the intersecting passage location of the first and second passages 32,34 than to the stop ring 64. The non-metallic seal 60 is preferably an oil resistant "O" ring. However, it should be recognized that lip or other conventional seals are suitable replacements and within the scope of the invention. The non-metallic seal 60 is positioned to seal the first cylindrical bore portion 36 at a location closely adjacent the first end 52 of the plug 44 and close to the intersection of the first and second passages 32,34.

A threaded plug pulling bore 76 is disposed axially in the second end portion 50 of the plug 44 and open at the second end 54. The plug pulling bore 76 is provided to assist in removal of the plug 44 from the first and second bore portions. The plug pulling bore is also useful in assisting in the installation of the plug 44 in the first and second cylindrical bore portions 36,38.

INDUSTRIAL APPLICABILITY

With references to the drawings an in operation, the plug 44 is disposed in the first fluid passing passage 32, at the end portion 42 of the first fluid passing passage 32 of the crankshaft 10, and blocks the otherwise open end portion 42 of the first fluid passing passage 32. This prevents a free flowing of lubricating fluid from the end portion 42. The extension of the first cylindrical end portion 48 of the plug 44 to the location at which the first end 52 of the plug 44 is closely adjacent to the intersecting location of the first and second passages 32,34 reduces the volume of dead space in the first fluid passing passage 32 and reduces the potential for particle collection and the blocking of fluid in the region of intersection of the first and second passages 32,34.

The non-metallic seal 60 being located in the first smaller diameter cylindrical bore portion 36 at a location closely adjacent to the flow of lubricating fluid passing the juncture of intersection of the first and second fluid passing passages 32,34 improves sealing and reduces contaminant collection.

The plug 44 being slidably disposed in the first and second cylindrical bore portions 36,38 facilitates ease of removal and installation of the plug 44. Because the plug 44 is not held in the first and second bores in a conventional mechanical manner, such as, by pressing, screw threading and the like, the plug 44 may be made from a softer material, such as aluminum and the like. The softer material reduces the potential for damage to the crankshaft 10 and facilitates ease of removal. This reduces the need for costly machining of the crankshaft 10, as is typical in the art with the harder material plug, and facilitates ease of fluid passing passage 36,38 cleaning and the like.

Because the plug 44 is held in position by way of the force of the resilient member 66 and the stop ring 64, the potential for excessive movement of the plug 44 in the bore 35 is prevented. Engagement of the chamfer 68, at the second end 54 of the plug 44, with the stop ring 64 centers the plug 44 radially in the bore 35 and maintains the plug 44 from damaging impacting movement in the second bore 38. The non-metallic seal 60 assists in maintaining the first cylindrical end portion 48 of the plug 44 from significant radial movement in the first cylindrical bore portion 36.

The ability of the resilient member 66 to deform and move into the above defined area 74, during assembly, assists in the placement of the stop ring 64 in the second annular groove 62 subsequent to positioning of the plug 44 in the first and second cylindrical bore portions 36,38. The threaded plug 44 pulling bore 76 facilitates attachment of an appropriate tool (not shown) for ease of installation and removal of the plug 44 without causing added damage to the crankshaft 10 and the fluid passing passages 32,34.

Other aspects, objects and advantages may be obtained from a reading of the specification, drawing and the appended claims.

What is claimed is:

1. A fluid passage plugging arrangement, comprising:

a crankshaft having a first fluid passing passage;

a plug having a longitudinal axis, first and second cylindrical end portions of different diameters substantially concentrically disposed about said longitudinal axis, and first and second opposed ends;

a shoulder located at a juncture of connection between the first and second cylindrical end portions of said plug;

a first annular groove disposed in and circumferentially about the first cylindrical end portion of the plug;

a bore having a first cylindrical bore portion, a second cylindrical bore portion, and being disposed in said crank shaft, said first cylindrical bore portion axially opening into the second cylindrical bore portion, said first and second cylindrical bore portions being concentric and defining at least a portion of the first fluid passing passage, said plug being disposed in the bore;

a transition step surface located within the second cylindrical bore portion;

a second annular groove disposed in the second cylindrical bore portion at a predetermined axial distance spaced from the transition step surface;

a non-metallic seal disposed in the first annular groove and being sealingly engaged with the first cylindrical bore portion;

a stop ring disposed in the second annular groove;

a resilient member disposed in the second cylindrical bore portion and engaged with the shoulder and the transition step surface, said resilient member urging the second cylindrical end portion of the plug into engagement with the stop ring and maintaining the plug from inadvertent movement within the bore.

2. A fluid passage plugging arrangement, as set forth in claim 1, including a second fluid passing passage disposed in the crankshaft and intersecting said first fluid passing passage at a predetermined location, said first cylindrical end portion of the plug being located in the first cylindrical bore portion at a preselected location closely adjacent to the predetermined location at which the second fluid passing passage intersects said first fluid passing passage.

3. A fluid passage plugging arrangement, as set forth in claim 1, including a chamfer located at the second cylindrical end portion of the plug, said chamfer being engaged with the stop ring and forcibly urging the stop ring into seating engagement with the second annular groove.

4. A fluid passage plugging arrangement, as set forth in claim 3, wherein said shoulder having a conical surface portion, said conical surface portion being engaged with the resilient member.

5. A fluid passage plugging arrangement, as set forth in claim 4, wherein said shoulder has a step surface axially spaced from the conical surface portion and providing with the second cylindrical bore portion an area for receiving the resilient member during compressive deformation of the resilient member.

6. A fluid passage plugging arrangement, as set forth in claim 5, wherein said conical surface portion being forcibly urged in a direction to deform the resilient member and cause the resilient member to move into the area during a placement of the stop ring in the second annular groove.

7. A fluid passage plugging arrangement, as set forth in claim 2, wherein said non-metallic seal being located nearer to the predetermined location at which the second fluid passing passage intersects said first fluid passing passage than to the stop ring.

8. A fluid passage plugging arrangement, as set forth in claim 7, wherein the non-metallic seal being an oil resistant "O" ring.

9. A fluid passage plugging arrangement, as set forth in claim 8, wherein said plug has a second end and a threaded plug pulling bore disposed axially in the second cylindrical end portion and opening at the second end.

10. A fluid passage plugging arrangement, as set forth in claim 6, wherein said resilient member being a ring shaped non-metallic member and being disposed about the first cylindrical end portion of the plug.

11. A fluid passage plugging arrangement, as set forth in claim 6, wherein said first and second cylindrical end portions of said plug being slidably disposed in the first and second cylindrical bore portions, respectively.

12. A fluid passage plugging arrangement, as set forth in claim 4, wherein said plug being made from an aluminum material.

* * * * *